US007887904B2

(12) United States Patent
Donohoe et al.

(10) Patent No.: US 7,887,904 B2
(45) Date of Patent: Feb. 15, 2011

(54) METHOD AND SYSTEM FOR PRINTING ELECTROSTATICALLY OR ELECTROGRAPHICALLY GENERATED IMAGES TO CONTOURED SURFACES OF CERAMIC AND GLASS ITEMS SUCH AS DISHWARE

(75) Inventors: John Donohoe, Big Flats, NY (US); Richard J. Lugen, Painted Post, NY (US); Kenneth A. Kirk, Corning, NY (US)

(73) Assignee: WKI Holding Company, Inc., Rosemont, IL (US)

( * ) Notice: Subject to any disclaimer, the term of this patent is extended or adjusted under 35 U.S.C. 154(b) by 1012 days.

(21) Appl. No.: 11/684,564

(22) Filed: Mar. 9, 2007

(65) Prior Publication Data

US 2008/0220188 A1 Sep. 11, 2008

Related U.S. Application Data

(60) Provisional application No. 60/894,053, filed on Mar. 9, 2007.

(51) Int. Cl.
*B41M 5/00* (2006.01)
*B44C 1/17* (2006.01)
*G03G 7/00* (2006.01)

(52) U.S. Cl. ..... 428/195.1; 428/32.71; 428/32.77; 428/32.86; 428/913.3; 428/914; 156/106; 106/313; 427/152

(58) Field of Classification Search ..... 428/32.71, 428/32.77, 32.86, 195.1, 913.3, 914; 156/106; 106/313; 427/152
See application file for complete search history.

(56) References Cited

U.S. PATENT DOCUMENTS

| | | | |
|---|---|---|---|
| 4,472,537 | A | 9/1984 | Johnson et al. |
| 4,542,052 | A | 9/1985 | Shadbolt et al. |
| 5,204,164 | A | 4/1993 | Songyoji et al. |
| 6,745,684 | B1 | 6/2004 | Zimmer et al. |

FOREIGN PATENT DOCUMENTS

| | | | |
|---|---|---|---|
| JP | 07 300382 | A | 11/1995 |
| JP | 08 011496 | A | 1/1996 |

OTHER PUBLICATIONS

PCT International Search Report Issued in connection with PCT Application No. PCT/US2008/02857.
International Preliminary Report on Patentability for PCT/US2008/002857, Jun. 12, 2009.
WKI Holding Company, Inc., Response to First Written Opinion and Accompanying Article 34 Amendment, PCT/US2008/002857, Jan. 27, 2009.

*Primary Examiner*—Mark Ruthkosky
*Assistant Examiner*—David J Joy
(74) *Attorney, Agent, or Firm*—McDermott Will & Emery LLP

(57) ABSTRACT

A glass or ceramic dishware item having a contoured surface with an image disposed thereon is provided. The image is transferred to the contoured surface from a layered ink composite. The layered ink composite is created by depositing a first layer of thermoplastic ink onto a silicone substrate. A ceramic toner configured as an image is electrographically deposited onto the first layer of thermoplastic ink. A second layer of thermoplastic ink is then deposited onto the ceramic toner. The image is transferred, at ambient temperature, from the layered ink composite to the contoured surface of the dishware item by moving the second layer of thermoplastic ink and the contoured surface into contact. The dishware item is then fired.

16 Claims, 4 Drawing Sheets

METHOD AND SYSTEM FOR PRINTING ELECTROSTATICALLY OR ELECTROGRAPHICALLY GENERATED IMAGES TO CONTOURED SURFACES OF CERAMIC AND GLASS ITEMS SUCH AS DISHWARE

CROSS-REFERENCE TO RELATED APPLICATIONS

This application claims priority from U.S. Provisional Application No. 60/894,053, filed Mar. 9, 2007 which is incorporated herein by reference.

TECHNICAL FIELD

The invention relates to method of printing on ceramic, glass-ceramic and glass, and more particularly for printing electrographically generated images to contoured surfaces of glass and ceramic items such as dishware.

BACKGROUND OF THE INVENTION

It is well known to apply designs to ceramic, glass-ceramic and glass products such as, for example, tableware, bakeware and other dishware to esthetically enhance the appearance of the product. Several methods have been employed for applying designs to such products.

According to one process, ceramic pigments are directly printed on glass and ceramic products by means of traditional printing techniques. According to such printing methods, pigments are baked into the surface of the product. As a result, a permanent printed image is obtained on the product. While this printing technique has met with some degree of success, it requires extensive manual preparation and labor. Moreover, the technique is not amenable to consistent reproduction of colors in large quantities. Among other disadvantages of such direct printing is the inability to maintain the resolution quality or the uniformity of the color printing.

Another known process for printing to ceramic, glass-ceramic and glass products relies on the technique of decal image transference. Typically, pigments are transferred via a transfer agent, such as a paper coated with gum arabic. In decal image transference, pigments can be applied to the transfer agent by various printing techniques. For example, conventional ceramic pigments can be applied to the transfer agent by screen printing, such as via rotary screen printing as illustrated in FIG. 2. However, rotary screen printing onto ceramic, glass-ceramic and glass products is labor intensive. It also requires image reproduction by a plurality of color dispensers, each of which requires precise transfer of the resultant inks to form an image. Moreover, image reproduction using rotary screen printing, as illustrated in FIG. 2, typically requires the addition of heat to set an image transferred to the workpiece. Alternatively, ceramic toner may be used in connection with decal transference instead of the conventional printing pigments or inks. In these instances, the ceramic toner can be applied to the transfer agent by electrostatic or electrophotographic reproduction method. In such a process, the transfer agent is applied to the ceramic or glass article at the desired position and either moistened or heated. The transfer agent is then removed leaving the pigmented image on the article. Following the transfer, the product is fired to fuse the pigment with the product.

While the decal image transference technique has also had some degree of success, it also has certain inherent disadvantages. One disadvantage is that the image must be printed on discrete sheets of the transfer agent that must be manipulated during further processing. Thus, the printing process is inherently less efficient than an otherwise automated process would be. Moreover, because each transfer agent sheet requires separate handling, consistent reproducibility of the image is extremely difficult.

Another process for printing to ceramic and glass products is described in U.S. Pat. Nos. 6,487,386 and 6,745,684 in which electrostatic or electrophotographic methods are used in a process to apply ceramic toner directly to the ceramic or glass product. The processes described in each of these patents also have inherent drawbacks. One particular drawback is the inability to permanently affix the image to a ceramic or glass product at or near ambient temperatures, without application of additional heat. Another of the drawbacks of the processes described in U.S. Pat. Nos. 6,487,386 and 6,745,684 is that they do not provide for an overcoat to retard cadmium release or maximize gloss.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

According to the present invention, a glass, glass-ceramic or ceramic dishware item having a contoured surface with an image disposed thereon is provided. The image is transferred to the contoured surface from a layered ink composite. The layered ink composite is created by depositing a first layer of thermoplastic ink onto a silicone substrate. A ceramic toner configured as an image is electrostatically or electrographically deposited onto the first layer of thermoplastic ink. A second layer of thermoplastic ink is then deposited onto the ceramic toner. The image is transferred, at or near ambient temperature, from the layered ink composite to the contoured surface of the dishware item by moving the second layer of thermoplastic ink and the contoured surface into contact with one another. The dishware item is then fired at a temperature of about 300° to 750° C.

According to another aspect of the present invention, a layered ink composite for use in applying digital printing to a contoured ceramic, glass-ceramic or glass substrate is provided. The layered ink composite includes an encapsulation layer, and image layer and a transfer layer. The encapsulation layer is a layer of thermoplastic ink that exhibits high permanent pressure sensitivity at room temperature. The encapsulation layer also exhibits a low affinity to silicone surfaces. The encapsulation layer is prepared from a formulation comprising a vitreous inorganic flux, either an amorphous polymer or a copolymer with an amorphous region, a plasticizer compatible with the amorphous polymer or copolymer, and an amorphous tackifying resin. The image layer is comprised of a ceramic toner. The transfer layer is a layer of thermoplastic ink that also exhibits high permanent pressure sensitivity at room temperature and a low affinity to silicone surfaces. The transfer layer is prepared from a formulation comprising either an amorphous polymer or copolymer with an amorphous region, a plasticizer compatible the amorphous polymer or copolymer, and an amorphous tackifying resin.

According to another aspect of the present invention, a method of printing an electrostatically or electrographically generated image to a contoured surface of a ceramic or glass workpiece is provided. The method includes the step of preparing a layered ink composite. More particularly, a first layer of thermoplastic ink is deposited onto a silicone substrate. The first layer of thermoplastic ink exhibits high permanent pressure sensitivity at room temperature and a low affinity to silicone surfaces. The first layer of thermoplastic ink is prepared from a formulation comprising a vitreous inorganic flux, either an amorphous polymer or a copolymer with an amorphous region, a plasticizer compatible with the amorphous polymer or copolymer, and an amorphous tackifying resin. A ceramic toner is deposited onto the first layer of thermoplastic ink in a configuration that defines a desired image; the desired image having been electrostatically or electrographically generated. A second layer of thermoplastic ink is then deposited onto the ceramic toner. The second layer of thermoplastic ink also exhibits high permanent pressure sensitivity at room temperature and a low affinity to silicone surfaces. The second thermoplastic ink layer is prepared from a formulation comprising, either an amorphous polymer or copolymer with an amorphous region, a plasticizer compatible with the amorphous polymer or copolymer and an amorphous tackifying resin. The image is then transferred, at or near ambient temperature, from the layered ink composite to a contoured surface of a workpiece. Specifically, the second layer of thermoplastic ink and the contoured surface of the workpiece are moved into contact with each other.

According to still another aspect of the present invention, a printing system for printing an electrographically generated image to a contoured surface of a ceramic or glass workpiece is provided. The printing system includes a cover coat print station, a transfer coat print station and a digital print engine.

The cover coat print station is comprised of a rotatable cover coat drum and a rotatable silicone transfer roller surface. The rotatable cover coat drum includes a cavity for holding and dispensing thermoplastic ink. In particular, the cover coat drum is adapted to hold and dispense thermoplastic ink exhibiting high permanent pressure sensitivity at room temperature and a low affinity to silicone surfaces. The cover coat drum also includes an inking surface that can be heated to a temperature above the melting point of the thermoplastic ink with which it employed. The rotatable silicone transfer roller surface is disposed in proximate contact to the inking surface of the cover coat drum. The silicon transfer roller surface receives the thermoplastic ink from the inking surface of the cover coat drum.

The transfer coat print station includes a rotatable transfer coat drum that has a cavity for holding and registerably dispensing thermoplastic ink. In particular, the transfer coat drum is suitable for use with thermoplastic ink that exhibits high permanent pressure sensitivity at room temperature and a low affinity to silicone surfaces. The transfer coat drum also has an inking surface that can be heated to a temperature above the melting point of the thermoplastic ink. The transfer coat print station also has a rotatable silicone transfer roller surface. The rotatable silicone transfer surface is disposed in proximate contact with the inking surface of the transfer coat drum. The rotatable silicone transfer surface receives thermoplastic ink from the inking surface of the transfer coat drum.

The digital print engine is disposed between the cover coat print station and the transfer coat print station. The digital print engine is coupled to a ceramic toner supply container and can generate an electrostatic or electrographic image from ceramic toner. The digital print engine includes an image roller that transfers an electrographically generated toner image to a transfer surface. The digital print engine also has a rotatable silicone transfer roller surface disposed in proximate contact with the image roller. The rotatable silicone transfer surface receives the generated toner image from the image roller.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
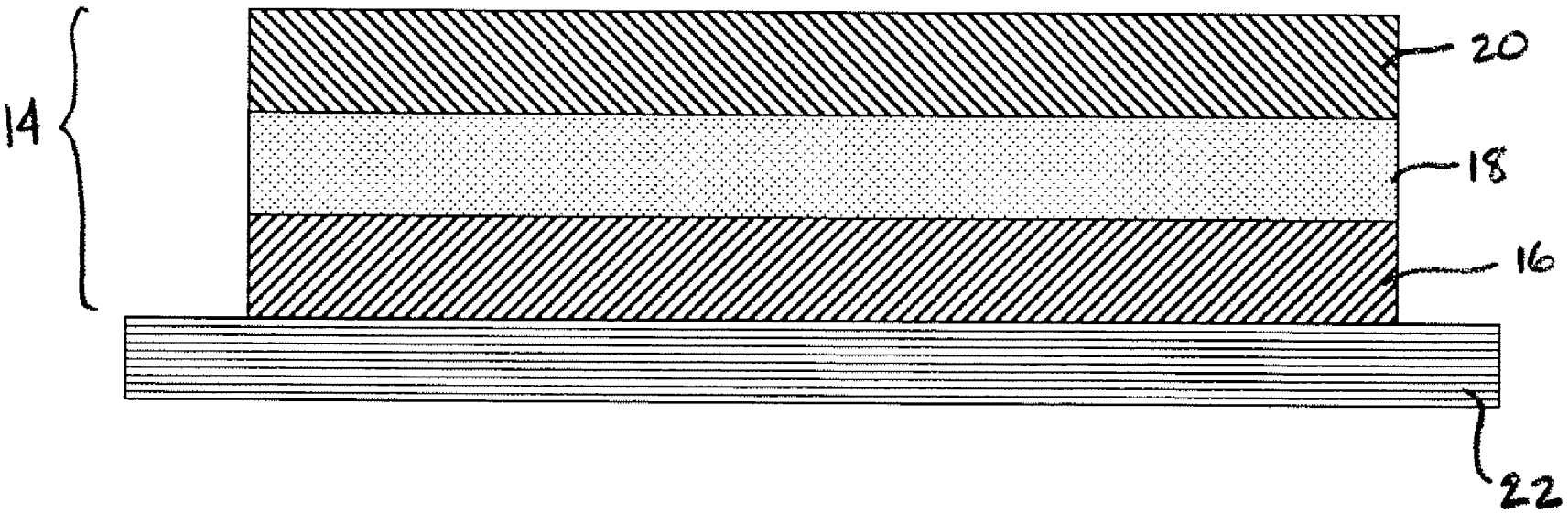
FIG. 1 is an explanatory cross-sectional view schematically showing one embodiment of the layered ink composite with silicone transfer substrate of the present invention.
Figure 2:
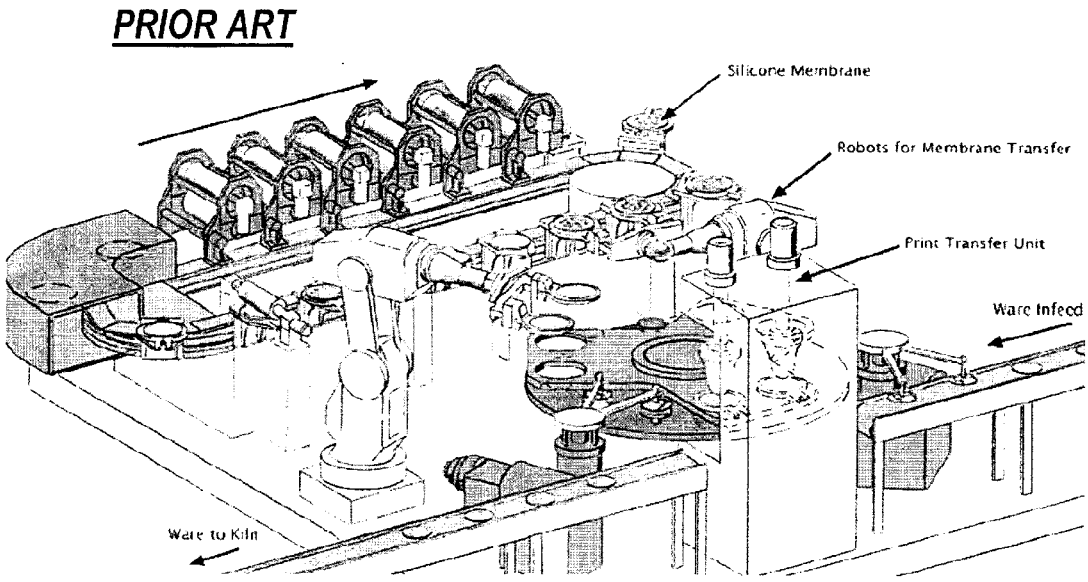
FIG. 2 is a perspective view of a prior art screen printing system.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 3:
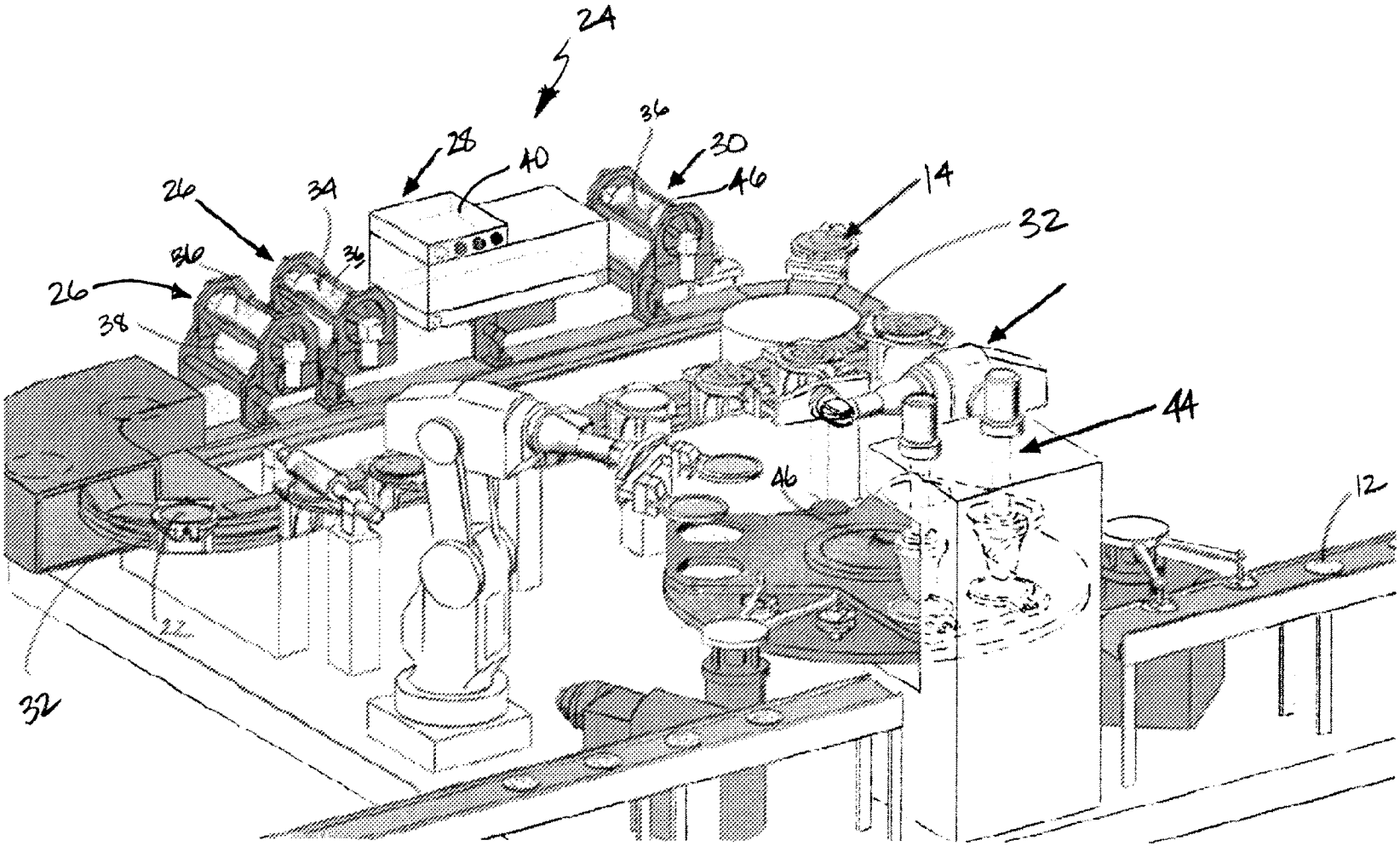
FIG. 3 is a perspective view of a printing system according to the present invention; and, FIG. 4 is a side view of the printing section of the printing system of FIG. 3.
Figure 4:
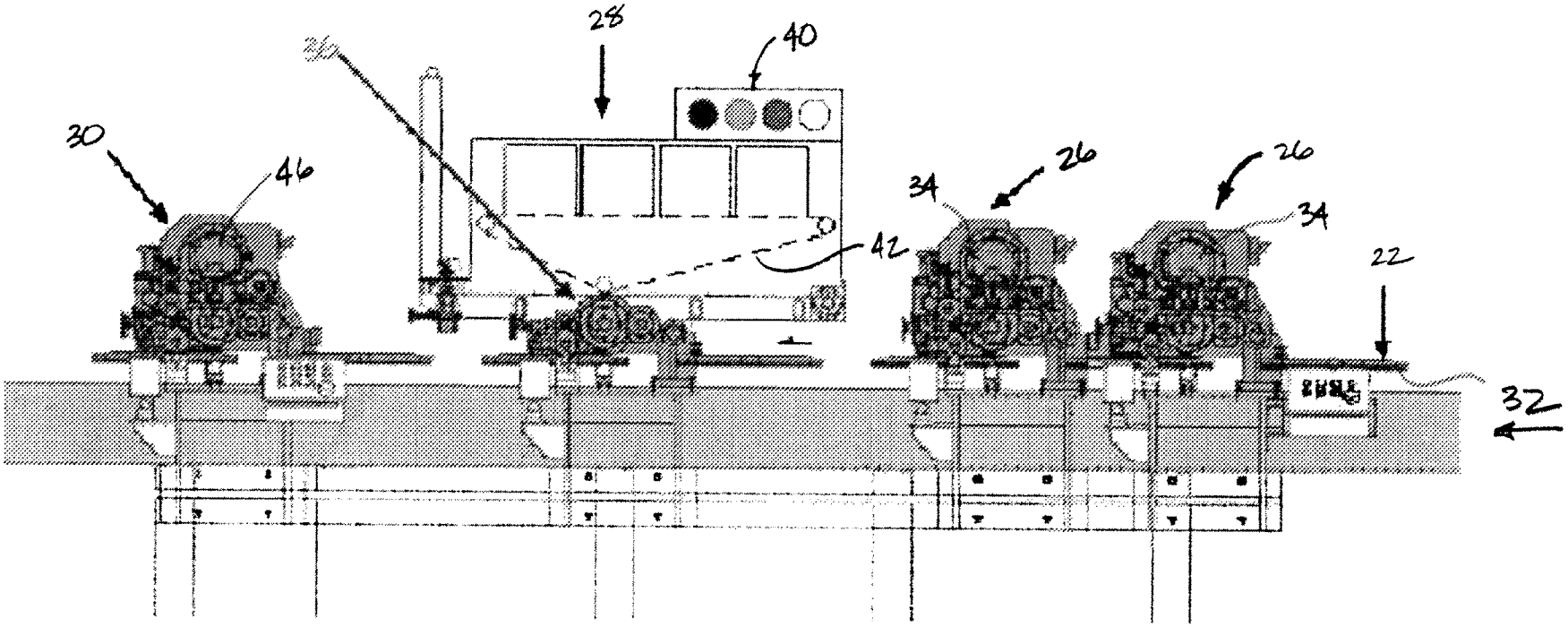

According to one embodiment, a method of printing an electrographically generated image to a contoured surface of a ceramic, glass-ceramic or glass workpiece is provided. More particularly, the method of printing can be used on contoured ceramic dishware formed and baked out of clay, porcelain, stoneware, earthenware, steatite, rutile, cordierite and cermet. The present invention can also be employed with glass dishware items. For example, the present invention can be suitably employed with glass tableware, servingware and bakeware sold under the brand name Corelle®, or on glass items formed from a simple combination of silicates. Referring now to FIGS. 1 and 3-4, the method generally includes the steps of preparing a layered ink composite 14 that includes a desired image to be transferred, transferring the image to the ceramic or glass item, and firing the item at an appropriate temperature.

As shown in FIG. 1, a desired image is transferred to the ceramic, glass-ceramic or glass item by building a layered ink composite 14. The layered ink composite 14 includes an encapsulation layer 16, and image layer 18 and a transfer layer 20. As will also be discussed in further detail herein, the encapsulation layer 16 is a thermoplastic ink that exhibits high permanent pressure sensitivity at room temperature. The encapsulation layer 16 also exhibits a low affinity to silicone surfaces. The encapsulation layer 16 is prepared from a formulation comprising a vitreous inorganic flux, either an amorphous polymer or a copolymer with an amorphous region, a plasticizer compatible with the amorphous polymer or copolymer, and an amorphous tackifying resin. The image layer 18 is comprised of a ceramic toner 18. As will also be discussed in further detail herein, the transfer layer 20 is a thermoplastic ink that also exhibits high permanent pressure sensitivity at room temperature and a low affinity to silicone surfaces. The transfer layer 20 is prepared from a formulation comprising either an amorphous polymer or copolymer with an amorphous region, a plasticizer compatible the amorphous polymer or copolymer, and an amorphous tackifying resin.

As shown in FIG. 1, a first layer of thermoplastic ink 16 is deposited onto a silicone transfer substrate 22. A ceramic toner 18 is then deposited onto the first layer of thermoplastic ink 16 in a configuration that defines a desired electrostatically or electrographically generated image. A second layer of thermoplastic ink 20 is then deposited onto the ceramic toner 18. The image is then transferred, at or near ambient temperature, from the layered ink composite 14 to a contoured surface of a workpiece 12. Specifically, the second layer of thermoplastic ink 20 and the contoured surface of the workpiece 12 are moved into contact with each other. The workpiece 12, bearing the desired image, is then fired to cure the workpiece 12. The preferred structure of the layered ink composite 14 will now be described.

The first layer of thermoplastic ink 16 is of the type particularly useful in those printing processes in which a transfer member is employed to print successive colors onto a transfer membrane which then transfers the multicolored print to the item. Preferably, the first layer of thermoplastic ink 16 is of the type described in U.S. Pat. No. 4,472,537 which is incorporated by reference herein. According to the present invention, the first layer of thermoplastic ink 16 or, the encapsulation layer 16, exhibits high permanent pressure sensitivity at or near room temperature and a low affinity to silicone surfaces. The first layer of thermoplastic ink 16 also exhibits high cohesive strength and high thermal stability. These properties enable the first layer of thermoplastic ink 16 to be readily transferred between surfaces for which it has differing degrees of affinity. Further, it permits release of the first layer of thermoplastic ink 16 from the transferring surface with much greater ease than any currently available formulation.

More specifically, according to the present invention, the first layer of thermoplastic ink 16 preferably exhibits high tack and cohesive strength when cooled to a solid or semi-solid (high viscosity) state. When the layered ink composite 14 is ultimately contacted with the contoured surface of the workpiece 12, the first layer of thermoplastic ink 16 will, in effect, form a cover coating to "encapsulate" the ceramic toner 18 that defines the desired image. As such, the first layer of thermoplastic ink 16 will assist in minimizing any cadmium release emanating from the ceramic toner 18.

The first layer of thermoplastic ink 16 will also provide a glossy finish to the design-bearing surface of the workpiece 12; whereas, the absence of such an encapsulating layer generally results in an relatively dull finish. Thus, it is preferable that a method for eliminating the discoloration resulting from carbonaceous residue be employed to maintain the clarity of the first layer of thermoplastic ink 16. For example, it is contemplated that the method described in U.S. Pat. No. 5,149,565 (incorporated herein by reference) be employed.

The first layer of thermoplastic ink 16 is preferably formulated from amorphous organic polymers or copolymers with amorphous regions, with low molecular weight tackifying resins and plasticizers. The primary purpose of the plasticizers is to adjust melt viscosity, but, where carefully selected, they can also be useful in enhancing the level of tack. It is preferable that low-to-medium molecular weight polymers are employed in connection with the present invention. In one preferred embodiment, the first layer of thermoplastic ink 16 is prepared from a formulation consisting essentially, in weight percent, of: (a) about 50 to 80% of a pigmented vitreous, inorganic flux; (b) about 2 to 20% of a cohesive strength imparting polymer with an average molecular weight of 4,000 to 200,000, wherein said polymer is selected from the group of ethylene copolymers with vinyl esters or vinyl acids, polyalkyl acrylate, polyalkyl methacrylate, polyalkyl acrylate or polyalkyl methacrylate or styrene copolymers with acrylic or methacrylic acid, styrene block copolymers with butadiene, cellulosic ethers, amorphous polyolefins, polyvinylpyrrolidone, polyethers, and polyesters; (c) about 5 to 25% of a plasticizer with an average molecular weight of 200 to 5000 which is compatible with said polymer selected from the group of alkylene glycol or glycerol esters of monocarboxylic acids, alkyl alcohol esters of mono-, di-, and tricarboxylic acids, polyesters of dicarboxylic acids and polyols, polyalkylene glycols, glyceryl triepoxy acetoxy stearate, polybutene, mineral oil, and epoxidized vegetable oils; and (d) about 2 to 20% of an amorphous tackifying resin with an average molecular weight of 500 to 10,000 and a ring and ball softening point of 35° to 115° C. selected from the group of hydrocarbon resins, terpenes, phenolics, rosin, and rosin derivatives.

Particularly desirable organic polymers include polymethylmethacrylate, polybutylmethacrylate, ethylvinyl acetate, ethyl methacrylate, and an amorphous polyolefin selected from the group of polyisobutylene and atacetic polypropylene. Alternatively, a copolymer can be employed. A particularly desirable rosin derivative for an amorphous tackifying resin is an ester derivative of hydrogenated rosin, the most preferred rosin derivative being selected from group of glycerol ester and pentaerythritol ester.

The second layer, or the image layer 18, is generally comprised of ceramic toner 18. Preferably the ceramic toner 18 is comprised of ceramic dye compositions of the kind described in U.S. Pat. No. 5,948,471 that include fine particles of ceramic pigments and suitable binding medium resins. More specifically, the preferable ceramic pigments generally include inorganic materials that exhibit a high degree of temperature stability such that they are suitable for fireproof or fire-resistant coloring of ceramic or glass products. Additionally, it is preferable that the ceramic pigments exhibit a high degree of refractability. However, it will be understood by one of ordinary skill in the art that any ceramic toner 18 suitable for deposition using electrostatic or electrographic methods can be employed without departing from the present invention.

The third layer of the layered ink composite 14, or the transfer layer 20, is also generally comprised of thermoplastic ink. The transfer layer 20 is provided as a chemical vehicle for transferring the toner 18 ink design and encapsulation layer 16 from the silicone transfer substrate 22 to the ceramic or glass workpiece 12. Thus it will be understood that the third layer of thermoplastic ink will exhibit sufficient tack to cause adherence to the ceramic or glass workpiece 12 upon contact, and still provide sufficient cohesive strength to adhere to the silicone transfer substrate 22.

In a preferred embodiment, this second layer of thermoplastic ink 20 has the same characteristics and is similar in formulation to the first layer of thermoplastic ink 16. For example, the transfer layer 20 also preferably exhibits relatively high permanent pressure sensitivity at room temperature and a relatively low affinity to silicone surfaces. Further, the second thermoplastic ink layer (i.e., the transfer layer) 20 is preferably prepared from a formulation that includes either an amorphous polymer or copolymer with an amorphous region, a plasticizer compatible with the amorphous polymer (or copolymer with an amorphous region), and an amorphous tackifying resin.

In one preferred embodiment, the second layer of thermoplastic ink 20 is prepared from a formulation consisting essentially, in weight percent, of: (a) about 2 to 20% of a cohesive strength imparting polymer with an average molecular weight of 10,000 to 200,000, wherein said polymer is selected from the group of ethylene copolymers with vinyl esters or vinyl acids, polyalkyl acrylate, polyalkyl methacrylate, polyalkyl acrylate or polyalkyl methacrylate or styrene copolymers with acrylic or methacrylic acid, styrene block copolymers with butadiene, cellulosic ethers, amorphous polyolefins, polyvinylpyrrolidone, polyethers, and polyesters; (b) about 5 to 25% of a plasticizer with an average molecular weight of 200 to 5000 which is compatible with said polymer selected from the group of alkylene glycol or glycerol esters of monocarboxylic acids, alkyl alcohol esters of mono-, di-, and tricarboxylic acids, polyesters of dicarboxylic acids and polyols, polyalkylene glycols, glyceryl triepoxy acetoxy stearate, polybutene, mineral oil, and epoxidized vegetable oils; and (c) about 2 to 20% of an amorphous tackifying resin with an average molecular weight of 500 to 10,000 and a ring and ball softening point of 35° to 115° C. selected from the group of hydrocarbon resins, terpenes, phenolics, rosin, and rosin derivatives. In one embodiment of the present invention, the encapsulation layer 16 also includes a vitreous organic flux.

As discussed above, according to a preferred embodiment of the present invention, the layered ink composite 14 is transferred from a flexible silicone transfer substrate 22. The silicone transfer substrate 22 will preferably have release characteristics to allow the design as collected in the layered ink composite 14 to be deposited onto the ceramic, glass-ceramic or glass surface of a workpiece 12. Preferably, the silicone transfer substrate 22 is of the type disclosed in U.S. Pat. No. 4,532,175 which is incorporated herein by reference. However, it is contemplated that the silicone transfer substrate 22 be formed from any formulation and using any method suitable for providing the release characteristics described herein.

According to the present invention, a printing system 24 for printing an electrostatically or electrographically generated image in accordance with the method described above is also provided. As shown in FIGS. 4-5, the system generally includes a cover coat print station 26, a digital print engine 28 and a transfer coat print station 30. In one embodiment, the cover coat print station 26, the digital print engine 28 and the transfer coat print station 30 are generally disposed in series such that the workpiece 12 may move from station to station in an "assembly line" fashion. The system 24 also preferably includes a conveyor assembly 32 positioned below the stations suitable for transporting the silicone transfer substrate 22 between the stations is positioned below. The conveyor 32 is preferably coupled to a control system that allows incremental indexing at each of the print stations 26, 28, 30 to accommodate the deposition of materials as appropriate.

The cover coat print station 26 is provided to apply the first layer of thermoplastic ink 16 (i.e., the encapsulation layer) to the silicone transfer substrate 22. As shown in FIGS. 4 and 5, the cover coat print station 26 includes a rotatable cover coat drum 34 and a rotatable silicone transfer roller surface 38. The cover coat drum 34 includes a cavity for holding and dispensing thermoplastic ink exhibiting the characteristics described herein. Preferably, the thermoplastic ink is heated to a temperature above its melting point so that it may be inserted into the cover coat drum 34 in liquid form. The cover coat drum 34 also includes an inking surface 36 that can be heated to a temperature in excess of the melting point of the thermoplastic ink. Thus, the thermoplastic ink can maintain its liquid consistency such that it may be deposited in appropriate quantities onto the rotatable silicone transfer roller surface 38. Preferably, the thermoplastic ink 16 is heated to a temperature of between 90° to 170° C. prior to the step of depositing the second layer of thermoplastic ink onto the ceramic toner. And, most preferably, the thermoplastic ink 16 is heated to a temperature of between 139° to 156° C. The inking surface 36 of the cover coat drum 34 can include a plurality apertures that are disposed in the configuration of the desired image. However, it is contemplated that inks that require heating to temperatures lower than their melting point, or which require no heating (i.e. sufficiently liquid at ambient), to maintain suitable viscosity and characteristics required for transfer and printing may be employed with the present invention.

The thermoplastic ink 16 flowing from the drum will be deposited onto the rotatable silicone transfer roller surface 38 in a configuration that mirrors the desired image. However, it will be understood that the apertures may be employed in the inking surface 36 of the cover coat drum 34 can assume any configuration suitable to dispense the thermoplastic ink within the cavity onto the silicone transfer roller surface 38.

The rotatable silicone transfer roller surface 38 receives thermoplastic ink 16 from the inking surface 36 of the cover coat drum 34 and is thusly disposed in proximate contact with the inking surface 36 of the cover coat drum 34. The silicone transfer roller surface 38 can assume the form of a drum. More specifically, it is contemplated that the silicone transfer roller surface 38 is a sheet of sufficient flexibility to be attached to a drum core. However, the silicone transfer surface 38 can be a drum made substantially of silicone material or materials. In any instance, the silicone transfer roller surface 38 will preferably have characteristics to allow the transfer roller surface 38 to collect the thermoplastic ink from the adjacently disposed inking surface 36 of the cover coat drum 34. At the same time the transfer roller surface 38 will preferably have release characteristics that allow the ink 16 to be subsequently deposited onto the silicone transfer substrate 22. To help facilitate transfer of the ink from the silicone transfer roller surface 38 to the subsequent silicone transfer substrate 22, the silicone transfer roller surfaces 38 are typically and preferably maintained at temperatures in excess of the ambient temperature.

According to one embodiment, the system includes a second cover coat print station 26. Accordingly, a second encapsulation layer 16 may be deposited on the first encapsulation layer 16 to increase the overall encapsulation qualities of the layered ink composite 14. Alternatively, the second cover coat print station 26 can be configured as a redundant print station used when the first cover coat print station 26 is non-operational. As with the first cover coat print station 26, the second cover coat print station 26 includes a rotatable cover coat drum 34 and a rotatable silicone transfer roller surface 38 as described above.

A transfer coat print station 30 is provided to apply second layer of thermoplastic ink 20 (i.e., the transfer layer) to the layered ink composite 14. As shown in FIGS. 4 and 5, the transfer coat print station 30 includes a rotatable transfer coat drum 46 and a rotatable silicone transfer roller surface 38. The transfer coat drum 46 includes a cavity for holding and dispensing thermoplastic ink 20 exhibiting the characteristics described herein. Preferably, the thermoplastic ink 20 is heated to a temperature above its melting point so that it may be inserted into the transfer coat drum 46 in liquid form. The transfer coat drum 46 also includes an inking surface 36 that can be heated to a temperature in excess of the melting point of the thermoplastic ink 26. Thus, the thermoplastic ink 20 can maintain its liquid consistency such that it may be deposited in appropriate quantities onto the rotatable silicone transfer roller surface 38. Preferably, the thermoplastic ink 18 is heated to a temperature of between 90 to 170° C. prior to the step of depositing the second layer of thermoplastic ink onto the ceramic toner. And, most preferably, the thermoplastic ink 18 is heated to a temperature of between 139 to 156° C. The inking surface 36 of the transfer coat drum 46 can include a plurality apertures that are disposed generally in the configuration of the desired image. However, it is contemplated that inks that require heating to temperatures lower than their melting point, or which require no heating (i.e. sufficiently liquid at ambient), to maintain suitable viscosity and characteristics required for transfer and printing may be employed with the present invention.

The thermoplastic ink flowing from the transfer coat drum 46 will be deposited onto the rotatable silicone transfer roller surface 38 in a configuration that mirrors the desired image. However, it will be understood that the apertures in the inking surface 36 of the transfer coat drum 46 be employed, and can assume any configuration suitable to dispense the thermoplastic ink 20 within the cavity onto the silicone transfer roller surface 38.

The rotatable silicone transfer roller surface 38 receives thermoplastic ink from the inking surface 36 of the transfer coat drum 46 and is thusly disposed in proximate contact with the inking surface 36 of the transfer coat drum 38. The silicone transfer roller surface 38 can assume the form of a drum. More specifically, it is contemplated that the silicone transfer roller surface 38 is a sheet of sufficient flexibility to be attached to a drum core. However, the silicone transfer surface 38 can be a drum made substantially of silicone material or materials. In any instance, the silicone transfer roller surface 38 will preferably have characteristics to allow the transfer roller surface 38 to collect the thermoplastic ink 20 from the adjacently disposed inking surface 36 of the cover coat drum 34. At the same time the transfer roller surface 38 will preferably have release characteristics that allow the ink 20 to be subsequently deposited onto the silicone transfer substrate 22. To help facilitate transfer of the ink 26 from the silicone transfer roller surface 38 to the subsequent silicone transfer substrate 22, the silicone transfer roller surfaces 38 are typically and preferably maintained a temperatures in excess of the ambient temperature.

As discussed above, the digital print engine 28 is disposed between the cover coat print station 26 and the transfer coat print station 30. Generally, the digital print engine 28 of the present invention is coupled to a ceramic toner supply 40 and can generate an electrostatic electrographic image from ceramic toner 18. It will be understood that the ceramic toner supply 40 will include ceramic toners 18 with colored pigments that allow the system to print multi-color images. The digital print engine 28 of the present invention will generally include an image roller 42 and a rotatable silicone transfer roller surface 38. According to the present invention, however, the image roller 42 transfers the electrographically generated toner 18 image to the adjacent transfer roller surface 38. However, it will be understood that digital printers capable of electrostatic or electrographic image printing using ceramic toner 18*s* is known in the art. For example, the digital print engine 28 may be of the types offered by data M Software & Engineering GmbH, Oberlaindern, Germany.

The rotatable silicone transfer roller surface 38 of the print engine 28 station is positioned adjacent to, and in proximate contact with, the image roller 42. The rotatable elastomeric transfer roller surface 38 receives the generated toner image (formed from the ceramic toner 18) from the image roller 42. The rotatable silicone transfer roller surface 38 can again assume the form of a drum. More specifically, it is contemplated that the silicone transfer roller surface 38 is a sheet of sufficient flexibility to be attached to a drum core. However, the silicone transfer drum can be a drum made substantially of silicone material or materials. The silicone transfer roller surface 38 will preferably have characteristics to allow the transfer roller surface 38 to collect the ceramic toner 18 from the adjacently disposed image roller 42. However, the silicone transfer roller surface 38, will also preferably have release characteristics that allow the ceramic toner 18 to be subsequently deposited onto the silicone transfer substrate 22. To help facilitate transfer of the ink from the silicone transfer roller surface 38 to the subsequent silicone transfer substrate 22, the silicone transfer roller surfaces 38 are typically maintained a temperatures in excess of the ambient temperature.

As discussed above, the present system preferably includes a conveyor assembly 32 suitable for transporting the silicone transfer substrate 22 between the stations. As shown in FIGS. 4-5, the conveyor assembly 32 generally runs below the stations such that it is positioned proximate the each of the rotatable silicone transfer roller surfaces 38. In this configuration, the silicone transfer substrate 22 can be advanced between the transfer roller surfaces 38 of the cover coat print station 26, the digital print engine 28 and the transfer coat print station 30.

The workpiece 12 and silicone transfer substrate 22, with layered ink composite 14, can then be transported by known methods to a printing station 44 which will include a printing die 46. At the print station 44 the silicone transfer substrate 22 and layered ink composite 14 is positioned such that the image faces the workpiece 12. The printing die 46 can then be displaced, by known drive mechanisms, to move the silicone transfer substrate 22, with the image formed from the layered ink composite 14, into contact with the surface of the workpiece 12 to be imprinted with the image. The image is thereby transferred at, or near, ambient temperature from the layered ink composite 14 to the contoured surface of the workpiece 12.

Thus, in employing the system described herein, an image can be applied to a contoured glass or ceramic dishware item. The image is transferred from a layered ink composite 14 created by (1) depositing a first layer of thermoplastic ink 16 onto a silicone transfer substrate 22; (2) depositing ceramic toner 18 onto the first layer of thermoplastic ink 16, the deposited ceramic toner 18 configured as an electrographically generated image; (3) depositing a second layer of thermoplastic ink 20 onto the ceramic toner 18; (4) transferring the image, at or near ambient temperature, from the layered ink composite 14 to the contoured surface of the dishware item by moving either the second layer of thermoplastic ink 20 or the contoured surface of the dishware item into contact with the other; and, (5) firing the dishware item, preferably at a temperature of about 300° to about 750° C.

While the specific embodiments have been illustrated and described, numerous modifications come to mind without significantly departing from the spirit of the invention, and the scope of protection is only limited by the scope of the accompanying claims.

What is claimed is:

1. A layered ink composite for use in applying digital printing to a contoured ceramic or glass substrate, the layered ink composite comprising:

a first thermoplastic ink layer, the first thermoplastic ink layer being prepared from a formulation comprising a vitreous inorganic flux, one of either an amorphous polymer and a copolymer with an amorphous region, a plasticizer compatible with one of either the amorphous polymer and the copolymer with an amorphous region, and an amorphous tackifying resin;

an image layer comprised of ceramic toner; and, a second thermoplastic ink layer, the second thermoplastic ink layer being prepared from a formulation comprising, one of either an amorphous polymer and a copolymer with an amorphous region, a plasticizer compatible with one of either the amorphous polymer and the copolymer with an amorphous region, and an amorphous tackifying resin.

2. The layered ink composite of claim 1, wherein the second ink layer further comprises a vitreous organic flux.

3. The layered ink composite of claim 1, wherein the amorphous polymer of at least one of the first and second layers has an average molecular weight of 10,000 to 200,000, the polymer being selected from the group of polyalkyl acrylate, polyalkyl methacrylate, polyalkyl acrylate or polyalkyl methacrylate or styrene copolymers with acrylic or methacrylic acid, cellulosic ethers, amorphous polyolefins, polyethers, and polyesters.

4. The layered ink composite of claim 1, wherein the plasticizer of at least one of the first and second layers are generally non-volatile at a temperature below 150° C., and has a molecular weight of 200 to 5000, the plasticizer being selected from the group of alkylene glycol or glycerol esters of monocarboxylic acids, alkyl alcohol esters of mono-, di-, and tricarboxylic acids, polyesters of dicarboxylic acids and polyols, polyalkylene glycols, glyceryl triepoxy acetoxy stearate, polybutene, mineral oil, and epoxidized vegetable oils.

5. The layered ink composite of claim 1, wherein the amorphous tackifying resin of at least one of the first and second layers has an average molecular weight of 500 to 10,000 and a ring and ball softening point between 35° and 115° C., the amorphous tackifying resin being selected from the group of hydrocarbon resins, terpenes, phenolics, rosin, and rosin derivatives.

6. A method of printing an electrographically generated image to a contoured surface of a ceramic or glass workpiece, the method comprising:

preparing a layered ink composite according to the steps of:

depositing a first layer of thermoplastic ink onto a silicone substrate, the first layer of thermoplastic ink being prepared from a formulation comprising a vitreous inorganic flux, one of either an amorphous polymer and a copolymer with an amorphous region, a plasticizer compatible with one of either the amorphous polymer and the copolymer with an amorphous region, and an amorphous tackifying resin;

depositing ceramic toner onto the first layer of thermoplastic ink, the deposited ceramic toner configured as an electrographically generated image; and, depositing a second layer of thermoplastic ink onto the ceramic toner, the second layer of thermoplastic ink being prepared from a formulation comprising, one of either an amorphous polymer and a copolymer with an amorphous region, a plasticizer compatible with one of either the amorphous polymer and the copolymer with an amorphous region, and an amorphous tackifying resin; and, transferring at or near ambient temperature the image from the layered ink composite to a contoured surface of a workpiece by moving one of either the second layer of thermoplastic ink and the contoured surface of the workpiece into contact with the other of the second layer of thermoplastic ink and the contoured surface of the workpiece.

7. The method of claim 6, further comprising the step of firing the workpiece at a temperature to oxidize and volatize the organic constituents of the thermoplastic ink.

8. The method of claim 6, further comprising the step of heating the thermoplastic ink to a temperature of between 90 to 170° C. prior to the step of depositing the first layer of thermoplastic ink onto the silicone substrate.

9. The method of claim 6, further comprising the step of heating the thermoplastic ink to a temperature of between 90 to 170° C. prior to the step of depositing the second layer of thermoplastic ink onto the ceramic toner.

10. The method of claim 6, wherein the second layer of thermoplastic ink further comprises a vitreous organic flux.

11. The method of claim 6, wherein the amorphous polymer of at least one of the first and second layers of thermoplastic ink has an average molecular weight of 4,000 to 200,000, and wherein the polymer is selected from the group of polyalkyl acrylate, polyalkyl methacrylate, polyalkyl acrylate or polyalkyl methacrylate or styrene copolymers with acrylic or methacrylic acid, cellulosic ethers, amorphous polyolefins, polyethers, and polyesters.

12. The method of claim 6, wherein the plasticizer of at least one of the first and second layers of thermoplastic ink is generally non-volatile at a temperature below 150° C., and has a molecular weight of 200 to 5000, the plasticizer being selected from the group of alkylene glycol or glycerol esters of monocarboxylic acids, alkyl alcohol esters of mono-, di-, and tricarboxylic acids, polyesters of dicarboxylic acids and polyols, polyalkylene glycols, glyceryl triepoxy acetoxy stearate, polybutene, mineral oil, and epoxidized vegetable oils.

13. The method of claim 6, wherein the amorphous tackifying resin of at least one of the first and second layers of thermoplastic ink has an average molecular weight of 500 to 10,000 and a ring and ball softening point between 35° and 115° C., the amorphous tackifying resin being selected from the group of hydrocarbon resins, terpenes, phenolics, rosin, and rosin derivative.

14. A glass or ceramic dishware item having a contoured surface with an image disposed thereon, the image having been transferred from a layered ink composite created by:

depositing a first layer of thermoplastic ink onto a silicone substrate;

depositing ceramic toner onto the first layer of thermoplastic ink, the deposited ceramic toner configured as an electrographically generated image;

depositing a second layer of thermoplastic ink onto the ceramic toner;

transferring at or near ambient temperature the image from the layered ink composite to the contoured surface of the dishware item by moving one of either the second layer of thermoplastic ink and the contoured surface of the dishware item into contact with the other of the second layer of thermoplastic ink and the contoured surface of the dishware item; and, firing the dishware item at a temperature of 300° to 750° C.

15. The dishware item of claim 14, wherein the first layer of thermoplastic ink exhibits high permanent pressure sensitivity at room temperature and a low affinity to silicone surfaces and is prepared from a formulation consisting essentially of a vitreous inorganic flux, one of either an amorphous polymer and a copolymer with an amorphous region, a plasticizer compatible with one of either the amorphous polymer and the copolymer with an amorphous region, and an amorphous tackifying resin.

16. The dishware item of claim 14, wherein the second layer of thermoplastic ink exhibits high permanent pressure sensitivity at room temperature and a low affinity to silicone surfaces and is prepared from a formulation comprising one of either an amorphous polymer and a copolymer with an amorphous region, a plasticizer compatible with one of either the amorphous polymer and the copolymer with an amorphous region, and an amorphous tackifying resin.

* * * * *